United States Patent [19]

Aronoff et al.

[11] 4,085,484

[45] Apr. 25, 1978

[54] APPARATUS FOR TREATING TUBULAR FABRICS

[75] Inventors: Edward I. Aronoff, St. Laurent; William J. McLay; Robert E. Mitchell, both of Montreal, all of Canada

[73] Assignee: Knit-Fin Machinery Ltd., Montreal, Canada

[21] Appl. No.: 640,854

[22] Filed: Dec. 15, 1975

[51] Int. Cl.[2] ..... D06C 5/00

[52] U.S. Cl. ..... 26/84

[58] Field of Search ..... 26/74, 80, 81, 83, 84; 68/244, 245, 256, 264

[56] References Cited

U.S. PATENT DOCUMENTS

| | | | |
|---|---|---|---|
| 118,519 | 8/1871 | Denton | 26/80 |
| 330,984 | 11/1885 | Kirby | 68/244 X |
| 671,533 | 4/1901 | Anderson | 68/264 |
| 966,280 | 8/1910 | Weis | 26/80 X |
| 2,880,114 | 3/1959 | Cohn et al. | 26/81 X |

*Primary Examiner*—Robert R. Mackey
*Attorney, Agent, or Firm*—Alan Swabey & Co.

[57] ABSTRACT

In the present invention, there is provided a pair of pressure rollers mounted on a frame for removing the excess liquid from the fabric at the nip formed between the rollers. A predetermined planar path passes through the nip of the rollers coincidental with the path of the tubular fabric, and a blade having a first flat elongated surface extends laterally of the path upstream of the squeeze rollers below and adjacent the path of the tubular fabric such that the tubular fabric is in contact with the surface. A second surface upstream of the first surface merges therewith and at an angle sloping downwardly from the first surface. A third surface downstream of the first surface merges therewith and is at an angle to the plane passing through the path of the fabric, such that the blade causes liquid and air to be drained from the tubular fabric as it passes over the first surface in contact therewith at relatively high speeds.

3 Claims, 5 Drawing Figures

22
18
17
32
20
19
2
30
16
40
14
2
10
40
12
E
42
38
15

19
46
16
18
22
32
46
20
34
14
15
30
F
24
37
42
26
38
44
28
10
10
12

46
18
16
20
22
32
30
19
34
14
F
46
40
42
36
15
24
37
38
44
26
12
10
10

APPARATUS FOR TREATING TUBULAR FABRICS

BACKGROUND OF THE INVENTION

1. Field of the Invention

The present invention relates to an apparatus for treating tubular fabrics.

2. Description of the Prior Art

In the treating of a tubular fabric, such as knitted fabric, which are formed in the shape of an elongated tube on a rotary knitting machine, it is customary to wash, dye, scour and calender the fabric while it is still in the form of a tube. After such treatment, the tube is normally split so that it can be cut and sewn into garments.

The handling of such a tubular fabric is relatively difficult since the fabric is knitted with interlocking loops of yarn and is, therefore, easily stretched in the longitudinal or transverse directions, and it is equally easily shrunk. The fabric in a tubular or a web form cannot be gripped firmly in handling since such handling would leave detrimental marks on the fabric.

In the handling of a tubular fabric, a problem of handling is also presented when the fabric contains a considerable amount of moisture after it has been washed, scoured or passed through a resin bath. For instance, if the fabric is carried at a relatively high speed through a pair of press rollers or other surfaces for pressing the fabric to squeeze out the liquid, a balloon has a tendency to form upstream of the pressing surface. This balloon is formed by liquid and air which accumulates within the tubular fabric. Different methods have been tried to remove the liquid from the fabric, such as applying conventional suction boxes instead of the rollers. It has been found, however, that with conventional suction boxes, the amount of negative pressure required to provide sufficient suction across the width of the fabric to prevent the formation of a balloon is excessive and uneconomical, while the drag experienced on the fabric is detrimental since it helps to stretch the fabric longitudinally.

Furthermore, in the type of equipment known in the trade as a quetch, including a floating spreader inside the tubular fabric driven by two edge rollers and a pair of driven squeeze rollers for squeezing the liquid and air out of the fabric downstream of the spreader, it has been found that, at relatively high speed, if there is a snag in the tubular fabric, the spreader is often dislodged from the drive rollers and jams into the nip formed between the driven squeeze rollers, sometimes causing damage not only to the fabric, but to the spreader and the rollers.

SUMMARY OF THE INVENTION

It is an aim of the present invention to provide an improvement in the above-mentioned quetch equipment which will act to drain some of the moisture and air within the fabric before the fabric enters the nip formed by the squeeze rollers so as to reduce the formation of a balloon in the tubular fabric.

It is a further aim of the present invention to provide means for stopping the drive rollers and squeeze rollers of the quetch as soon as the spreader is dislodged, and for separating the squeeze rollers to allow the spreader to pass between the rollers to minimize the damage both to the rollers and the spreader in case the spreader is dislodged from the rollers.

In a construction in accordance with the present invention, there is provided a pair of pressure rollers mounted on a frame for removing the excess liquid from the fabric at the nip formed between the rollers, a predetermined planar path passing through the nip of the rollers coincidental with the path of the tubular fabric, a blade having a first flat elongated surface extending laterally of the path upstream of the squeeze rollers below and adjacent the path of the tubular fabric such that the tubular fabric is in contact with the surface, a second surface upstream of the first surface merging therewith and at an angle sloping downwardly from the first surface, a third surface downstream of the first surface merging therewith and being at an angle to the plane passing through the path of the fabric, such that the blade causes liquid and air to be drained from the tubular fabric as it passes over the first surface in contact therewith at relatively high speeds.

In a more specific embodiment of the present invention, the blade is mounted at each end to pivoting members. The pivoting members are pivotably mounted to a common frame. At least one of the squeeze rollers is journaled at each end to a lever pivoted to the common frame. Activating means are adapted to move the levers so as to separate the squeeze roller from the squeeze roller journaled to the frame. Actuating means are connected to the blade and to the means to move the levers mounting the squeeze roller whereby, when an obstacle hits the blade during operation, the actuating means will activate the moving means to open the gap between the squeeze rollers.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENT

Figure 1:
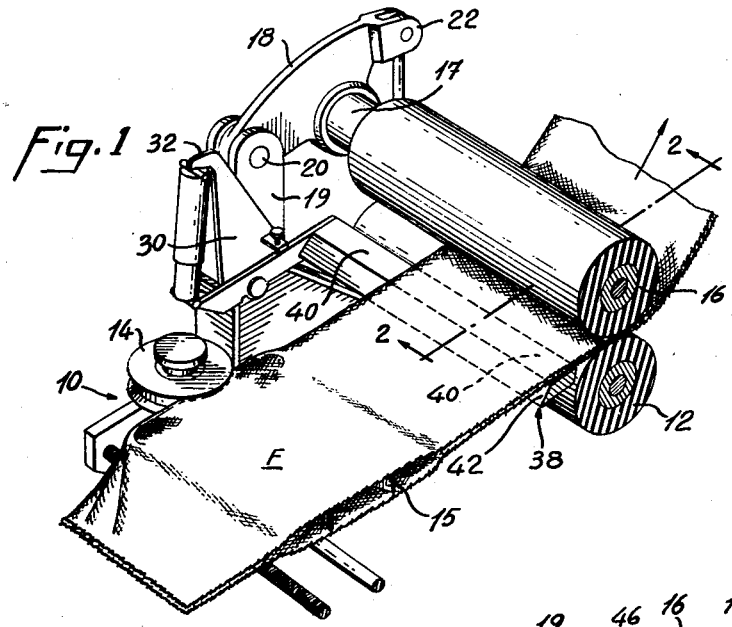
FIG. 1 is a perspective fragmentary view of a quetch incorporating the present invention.

Referring now to the drawings, and particularly to FIG. 1, there is shown a part of the common frame 10 on which one end of the lower squeeze roll 12 is journaled. A drive roller 14 is also provided, engaging a spreader through the tubular fabric F.

Figure 2:
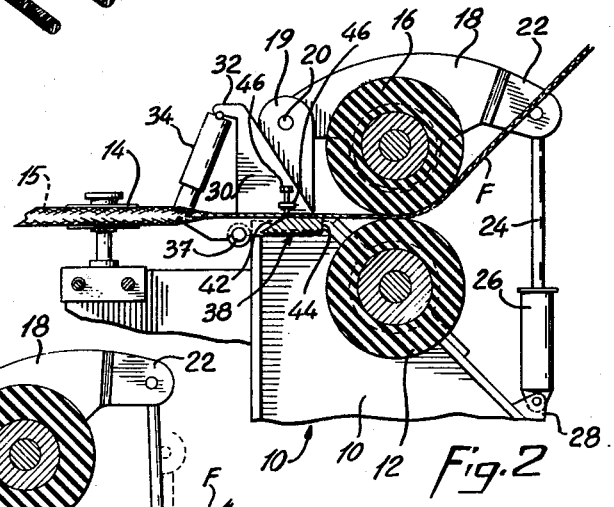
FIG. 2 is a vertical cross-section taken along line 2—2 of FIG. 1.
Figure 3:
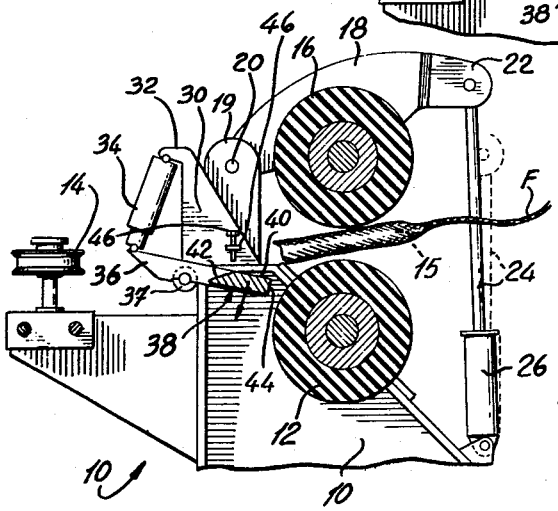
FIG. 3 is a view similar to FIG. 2, but showing a different position and operation of the device shown in FIGS. 1 and 2.

The other squeeze roller 16 includes a shaft 17 and is journaled to a pivoting lever member 18. The member 18 is pivotably mounted to a stub shaft 20 subtended between a fork bracket 19. A piston 24 is similarly connected to a fork 22 at the other end of the lever 18. The piston 24 is associated with a cylinder 26, as shown in FIGS. 2 and 3. The cylinder 26 is itself pivoted to a bracket 28 on the common frame 10.

It goes without saying that all of the elements being described on the frame 10 and illustrated here have corresponding equivalents on the other side of the frame supporting the other ends of the squeeze rollers.

An upstanding member 30 including a nose 32 supports one end of a telescoping hydraulic cylinder arrangement 34. The other end of the telescoping cylinder 34 is connected to a pivoting lever member 36 which pivots about the pivot member 37. One end of a blade 38 is fixed to the end of the lever 36. Of course, the other end of the blade 38 is similarly fixed to a corresponding lever 36. The blade 38 includes a top flat elongated surface 40 and an upstream sloped surface 42. A downstream surface 44 is also provided on the blade 38. The blade 38 is normally in the position shown in FIGS. 1 and 2, that is, with the surface 40 in a horizontal plane adjacent a plane coinciding with the path of the travelling tubular fabric such that the tubular fabric is in contact with the top surface 40 of the blade 38.

An adjustable limit screw 46 can be mounted on the upstanding member 30 in order to limit the upward movement of the blade 38, that is, to correspond to the position described above.

Figure 4:
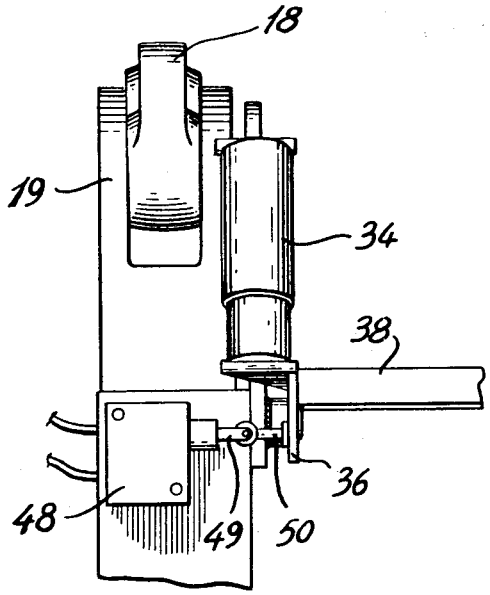
FIG. 4 is a detail of the apparatus shown in FIG. 1.
Figure 5:
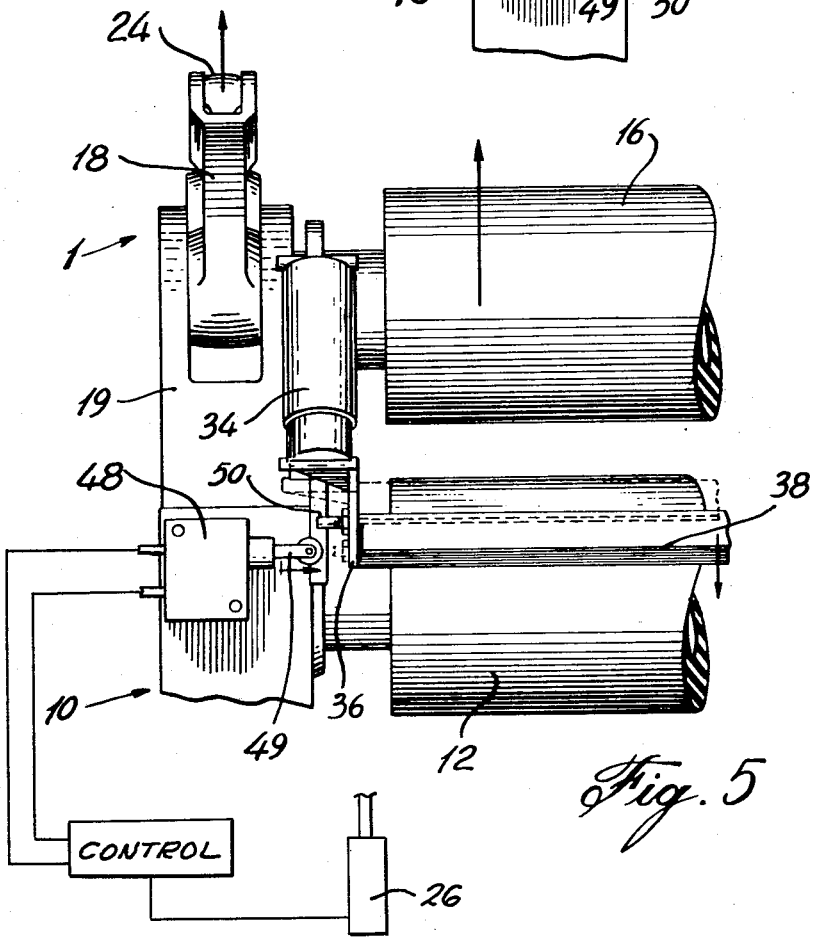
FIG. 5 is an elevational view showing the same detail as FIG. 4 but at a different operating position similar to that shown in FIG. 3.

Referring now to FIGS. 4 and 5, there is shown a switch 48 mounted on the common frame having a sliding switch member 49 which is adapted to be engaged by an abutment 50 extending from the lever 36. In its normal operating position, the abutment projection 50 engages the switch member 49 pressing it against a spring (not shown) within the switch 48, as shown in FIG. 4.

In operation, it has been found that as a tubular fabric containing a high content of moisture and air after having, for instance, been taken from a washing and scouring station, and as it passes at high speed over the spreader 15 between the pressure squeeze rolls 12 and 16, much of the liquid will drain if it passes over a flat surface having a downstream edge, as shown at 38 and 42. The drainage caused by the blade 38 is sufficient in most cases to prevent ballooning before the fabric enters the rollers 12 and 16 when the fabric is travelling at speeds of between 40 and 90 feet per minute.

A safety feature is also incorporated within the blade 38 by the manner in which it is mounted to the common frame 10. If, for instance, the spreader were to be dislodged from the drive rollers 14 by means of a snag in the tubular fabric F, the spreader will immediately advance downstream and will abut the sloped surface 42 of the blade 38 forcing the blade 38 to move downwardly, pivoting clockwise about the pivot 37 and causing the cylinders 34 to telescope. At the same time, the projection 50, shown in FIGS. 4 and 5, will move with the lever 36 thereby freeing the switch member 49 to move outwardly from the switch box 48 thereby actuating the cylinder 26, forcing the piston 24 to project therefrom to make the lever 18 pivot counterclockwise, thereby lifting the squeeze roller 16 from its position in contact with the roller 12, in order to leave a gap such as shown in FIGS. 3 and 5. After the spreader has been replaced, a switch (not shown) can be activated to cause the telescoping cylinder 34 to re-extend itself under fluid pressure, thereby pivoting the blade 38 counterclockwise until it abuts the adjustment screw 46 and is in its normal position.

We claim:

1. An apparatus for treating tubular fabrics comprising a frame on which at least a pair of pressure squeeze rollers are provided forming a nip, a plane defined at the nip coincidental with the path of the tubular fabric passing therethrough, spreader means provided in the path upstream of the nip and subtended between drive rollers, a blade extending laterally of the path of the fabric in contact with the tubular fabric, but below it, upstream of the squeeze rollers and downstream of the spreader, at least one of the squeeze rollers being journaled at each end to one of a pair of levers pivoted to the frame, means adapted to move the levers so as to move the one squeeze roller from the other, actuating means connected to the blade and to the means for moving the levers such that if an obstacle hits the blade during the operation, the actuating means will activate the moving means to open the gap between the squeeze rollers.

2. An apparatus as defined in claim 1, wherein the blade is mounted on a pivoting lever at each end thereof and the levers are pivoted to the frame, switch means associated with the lever means whereby when the blade is hit by an obstacle, it is caused to rotate counterclockwise on impact causing the lever means to actuate the switch means to thereby activate the moving means.

3. An apparatus as defined in claim 2, wherein the moving means include a pair of hydraulic cylinder and piston arrangements connected to the levers to which the one squeeze roller is journaled so as to move the levers.

* * * * *